US005437519A

United States Patent [19]

Bullivant

[11] Patent Number: 5,437,519

[45] Date of Patent: Aug. 1, 1995

[54] PILES AND PILE FORMING METHODS

[75] Inventor: Roger A. Bullivant, Newton Solney, England

[73] Assignee: Roger Bullivant of Texas, Inc., Grand Prairie, Tex.

[21] Appl. No.: 108,116

[22] Filed: Aug. 17, 1993

[30] Foreign Application Priority Data

Aug. 26, 1992 [GB] United Kingdom ..... 9218153

[51] Int. Cl.[6] ..... E02D 5/34

[52] U.S. Cl. ..... 405/239; 405/252

[58] Field of Search ..... 405/229, 231, 232, 233, 405/239, 244, 252, 255

[56] References Cited

U.S. PATENT DOCUMENTS

| | | | |
|---|---|---|---|
| 1,296,628 | 3/1919 | Cooney | 405/239 |
| 1,647,925 | 11/1927 | May | 405/229 X |
| 2,065,507 | 12/1936 | Alexander | 405/252 |
| 3,581,508 | 6/1971 | Junius | 405/255 |
| 4,838,737 | 6/1989 | Quimby | 405/229 X |
| 5,257,489 | 11/1993 | Angelette | 405/252 X |

FOREIGN PATENT DOCUMENTS

| | | |
|---|---|---|
| 2120304 | 11/1983 | United Kingdom . |
| 2259104 | 3/1993 | United Kingdom . |

*Primary Examiner*—David H. Corbin

*Attorney, Agent, or Firm*—Richards, Medlock & Andrews

[57] ABSTRACT

A cast in situ pile (12, 112) has a pile cap assembly (14, 114), comprising a plate (16, 116) with fixing bolts (18, 118) extending upwardly therefrom and at least one tube (28, 128) extending downwardly therefrom. The pile cap assembly is fitted to the pile prior to the concrete setting, whereby the pile cap assembly can be moved relative to the unset pile to achieve optimum positional accuracy.

24 Claims, 2 Drawing Sheets

PILES AND PILE FORMING METHODS

FIELD OF THE INVENTION

The present invention relates to improvements in or relating to piles, and methods of forming piles. In one particular aspect, the invention relates to pile capping assemblies and the methods of forming pile capping assemblies for supporting tall structural members.

BACKGROUND OF THE INVENTION

As a result of ever advancing techniques, piles can be driven into the ground with increasing accuracy and with minimum disturbance, but it is still recognized that it is difficult to drive a pile with total positional accuracy and with truly vertical orientation. Such conditions can be required if a tall member is to be supported on the top of a pile or an assembly of piles, whether the tall member is free-standing, for example a lamp standard or a flag pole, or part of a larger structure, for example an upright member of a portal frame.

The commonly employed practice for fixing tall members, such as lamp standards or flag poles, in the ground is to excavate a footing hole in the ground and then cast in the footing hole a mass of cementitious material sufficient to provide an adequate foundation for the tall member. This procedure is not only costly in materials but is also time consuming and inconvenient. It is well known that modern pile formation techniques can position piles giving sufficient load bearing capability at almost any location with the minimum of disruption to the surroundings, but it is also recognized that with the commonly employed pile formation techniques the piles cannot be positioned with total accuracy or guaranteed verticality.

SUMMARY OF THE INVENTION

It is an object of the present invention to obviate or at least mitigate the foregoing and other disadvantages. It is also an object of the present invention to provide a pile assembly which can be formed utilizing existing in situ pile forming techniques in such a way that the accuracy of the positioning of the structure carried by the pile can be guaranteed in all axes. Another object of the invention is to provide an accurately positioned and accurately oriented base for a tall member, such as a flag pole or lamp-standard.

According to the present invention, there is provided a method of forming a pile comprising forming a pile hole in the ground, pouring a settable mixture into the pile hole thus formed, and, before the settable mixture sets, accurately positioning a pile cap assembly at the top of the thus formed pile, wherein the assembly comprises a mounting plate with a tubular member projecting downwardly therefrom when in use, the tubular member being located in the settable mixture and manoeuvred therein prior to the mixture setting such that the mounting plate is positioned with accuracy when the mixture sets. The base of the tall structural member can then be secured to the mounting plate, e.g. by fixing means provided on the top plate, for accurately positioning the tall structural member. A final adjustment of the position of the base of the tall structural member with respect to the position of the top plate can be made.

Further according to the present invention, there is provided a pile comprising a pile member formed by casting a settable mixture in situ and incorporating in the upper end of the pile member a pile cap assembly comprising a mounting plate on the top of the pile member, and a tube projecting downwardly from the mounting plate, with the tube being accurately positioned within the settable mixture of the uppermost portion of the pile member. The mounting plate can include fixing means by which further members can be adjustably attached thereto. In one embodiment, the mounting plate is provided with fixing means, such as threaded members, to which the base of a tall structural member can be secured for accurately positioning the tall structural member. The base of the tall structural member can be provided with oversized holes, with respect to the threaded members, to permit a final adjustment of the orientation of the tall structural member.

The pile can be a concrete pile which is cast in situ in a pre-formed pile hole in the ground, or the pile can be formed by positioning a pile casing in the ground and then filling the pile casing with concrete.

While one embodiment of the mounting plate of the pile cap assembly has only one tube projecting downwardly therefrom, another embodiment has at least two spaced apart tubes projecting downwardly therefrom, with each tube being adapted for being located at the top of a respective one of a pair of adjacent piles. Each tube can contain a fixing rod which projects downwardly below the lower end of the tube, with an anchor member being mounted on the lower end of the rod.

BRIEF DESCRIPTION OF THE DRAWINGS

Embodiments of the present invention will now be described, by way of example only, with reference to the accompanying drawings; in which.

DETAILED DESCRIPTION

Figure 1:
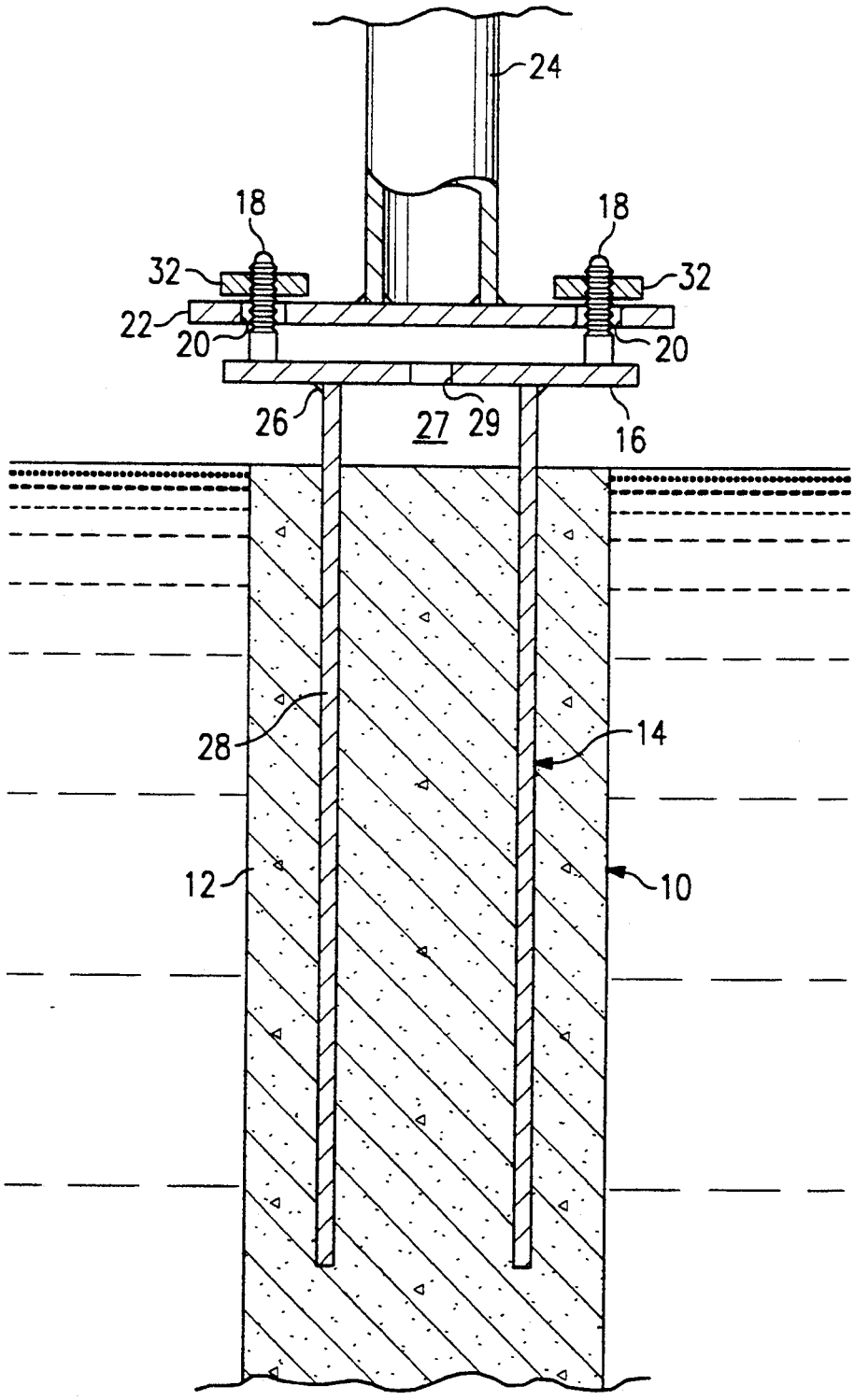
FIG. 1 is a diagrammatic view representing a vertical cross section of the top portion of a pile having a pile cap assembly and a structural member affixed thereto.

According to the present invention a pile hole 10 is formed in the ground as closely as possible to the position where the tall member is to be supported. The pile hole 10 can be formed by any convenient means, for example by augering a borehole or by driving a hollow steel casing downwardly into the ground by vibratory means or any other appropriate means. The pile hole 10 is then filled with settable concrete 12, with or without reinforcing steel members therein. Prior to the concrete setting to form the pile, a pile cap assembly 14 is located in the top portion of the pile being formed. The pile cap assembly 14 comprises a mounting plate 16 which is positioned so as to extend in the desired orientation plane, e.g. the horizontal plane. It is presently preferred that the horizontal dimensions of the mounting plate 16 be greater than the corresponding dimensions of the hole 10. The mounting plate 16 is provided with suitable fixing means, for example threaded studs 18, attached to the upper surface of the mounting plate 16, with the position of each fixing means 18 corresponding to the position of fixing holes 20 provided in a base plate 22 of the tall structural element 24 to be supported on the pile. The upper end of each stud 18 can be threaded to receive a fixing nut 32, whereby the tall structural member 24 can be securely fixed to the pile cap assembly 14.

The upper end of a hollow steel tube 28 is fixed to the underside of the base plate 16 by suitable means, e.g. a fillet weld 26, and the lower end of the steel tube 28 is open. The outside diameter of the tube 28 is substantially less than the outside diameter of the pile hole 10 such that the tube 28 can be manoeuvred both laterally and vertically in the pile hole 10 containing the settable concrete, before the concrete sets, to ensure that the fixing studs 18 are accurately positioned in their desired locations and that the plate 16 is positioned in the desired orientation plane. However, it is presently preferred that the diameter of the tube 28 be at least as great as one-fourth of the diameter of the hole 10. The pile cap assembly 14 is then maintained in this desired position until the concrete sets, thereby providing an adequate support for the tall structure 24 so that the tall structure 24 is accurately positioned with respect to all axes. If it is desirable that provision be made for a slight final adjustment of the orientation of the base plate 22 of the tall structure 24, with respect to the plane of mounting plate 16, after the concrete 12 has set in the pile hole 10, this can be achieved by making the fixing holes 20 in the base plate 22 slightly oversized with respect to the mounting studs 18, thereby permitting the base plate 22 to be slightly reoriented along the axes within the orientation plane of mounting plate 16.

In one embodiment the upper end of tube 28 is completely closed by mounting plate 16 to minimize the amount of the settable concrete which enters the chamber 27 within the tube 28 during the insertion of the tube 28 into the settable concrete 12. In another embodiment, an opening 29 is provided through the mounting plate 16 so as to provide fluid communication between the interior 27 of tube 28 and the atmosphere above the mounting plate 16, thereby permitting air to escape from the chamber 27 within the tube 28 and concrete to enter the chamber 27 within the tube 28 during the movement of the tube 28 downwardly into the settable concrete 12. As shown in FIG. 1, the interior chamber 27 of the tube 28 can be free of any components other than concrete and an air space.

Figure 2:
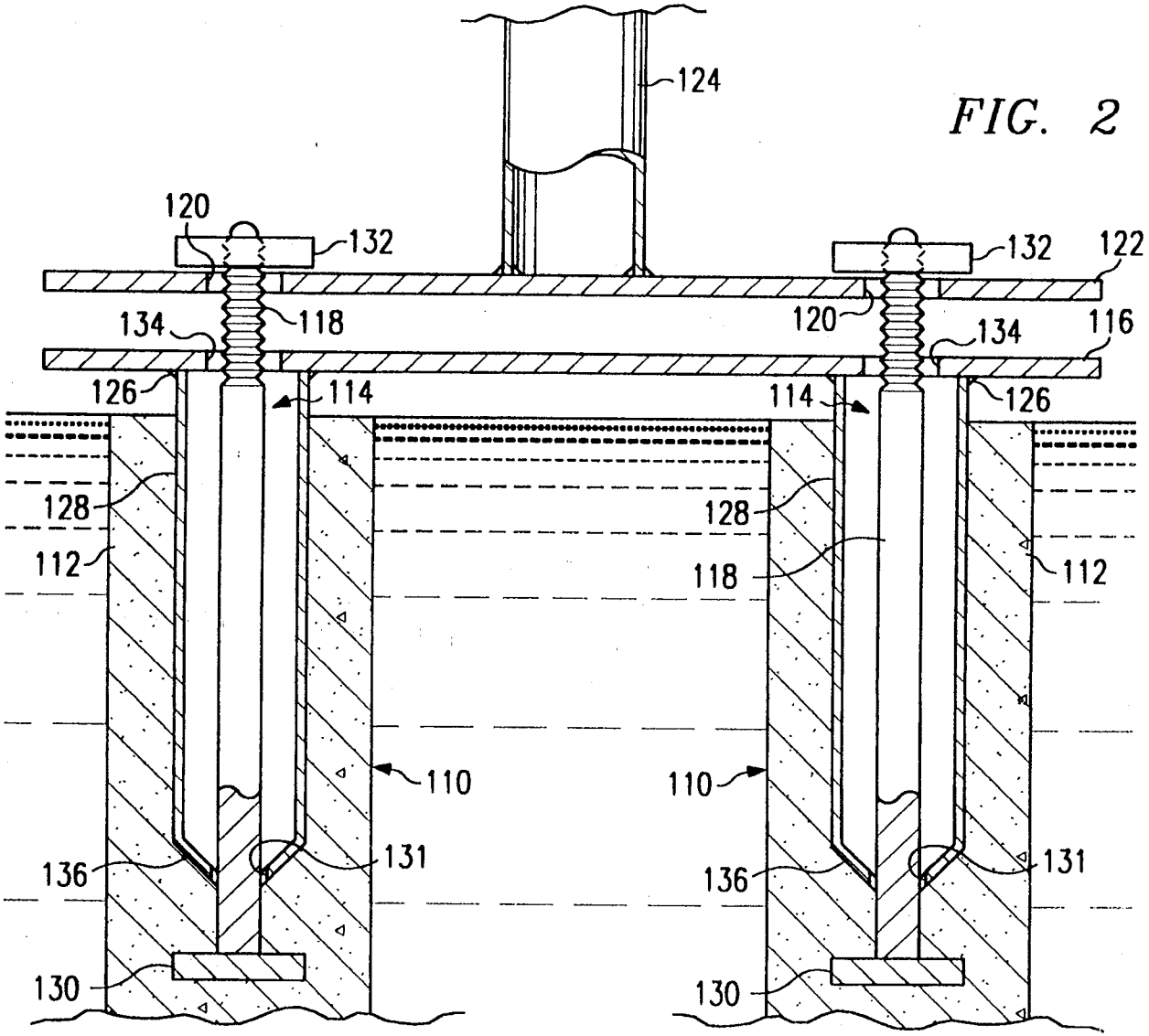
FIG. 2 is a similar diagrammatic view of a modified pile structure including a pile cap assembly and a plurality of piles.

FIG. 2 illustrates a modified pile and pile cap assembly which is particularly suitable for supporting the uprights in building structures utilizing portal frames. One form of construction of these building structures involves fixing the base of the upright members, and according to traditional techniques this has been achieved by attaching the base of each of the upright members to a large mass of reinforced concrete provided in a pre-excavated trench or hole. This fixed base construction technique can result in a cost saving in steel. However, as the concrete foundation is very large, the increased production costs, both in time and materials, negates the saving in steel costs. It has been realized that the disadvantages of the large concrete mass can be obviated or mitigated by fixedly supporting the base of each of the uprights of the portal frame on the top of a pile or an assembly of piles. As indicated above, modern pile forming techniques enable piles to be driven with a minimum of disruption and inconvenience so that it is possible to erect a portal frame building utilizing piles in an already prepared surface, giving rise to clear constructional advantages. However, as recognized above, the total accuracy and verticality of piles cannot be guaranteed utilizing existing techniques. Nevertheless, according to the modification shown in FIG. 2, a vertical member of a portal frame can be fixed to the top of a pile assembly with a guarantee of accuracy in all axes.

In FIG. 2, a pair of pile holes 110 are formed in the ground at spaced apart locations so as to be along side each other (although an assembly of three or more piles can be utilized if necessary). After formation by any suitable technique the pile holes 110 are filled with settable concrete 112 incorporating, where necessary, reinforcing bars (not shown). Prior to the concrete 112 setting, a pile cap assembly 114, comprising a single mounting plate 116 having a pair of downwardly projecting tubes 128, is positioned in the unset concrete 112 so that each of the tubes 128 is located in the unset concrete 112 at the upper end of a respective one of the pile holes 110. It is presently preferred that the horizontal dimensions of the single mounting plate 116 be greater than the corresponding dimensions of the combination of the holes 110 including the spaces between the holes 110. Prior to the final setting of the concrete, the dimensional accuracy of the positioning of the pile assembly 114 is attained and is then maintained while the concrete 112 sets. Each tube 128 is fixed by a fillet weld 126 to the underside of the single mounting plate 116, and a fixing member 118, e.g., a rod, is positioned at least substantially coaxially within a tube 128. Each rod 118 has an anchoring member such as plate 130 at its lower end arranged to be received within the settable concrete 112 and then firmly anchored when the concrete 112 sets to form the pile. Each rod member 118 passes through oversized holes 134 in the mounting plate 116, whereby the fixing rod 118 can be positioned with total accuracy prior to the setting of the concrete. The upright member 124 of the portal frame has a single base plate 122 affixed thereto. The base plate 122 has holes 120 therein at locations corresponding to the location of holes 134 in the single mounting plate 116 so that each of the fixing rods 118 can pass through a respective set of holes 134 and 120. The holes 120 in base plate 122 can be oversized, with respect to the rod members 118, in order to permit adjustment for final positional accuracy. The upper end of each rod member 118 can be threaded to receiving a fixing nut 132, whereby the tall structural member 124 can be securely fixed to the pile cap assembly 114.

The lower end of each tube 128 can be provided with an inwardly and downwardly converging guide 136 having a reduced bottom opening to assist in the centering of the rod 131 118 within the tube 128. The anchoring plate 130 can be a rigid plate attached to the rod 118 or it can comprise one or more umbrella-like rib members which can be folded against the rod 118 for insertion through the reduced bottom opening 131 in the guide 136 and then expanded outwardly to form the final anchor structure.

Various modifications can be made without departing from the scope of the present invention. For example, the pile cap assemblies can take any suitable form provided that they allow adjustment prior to the final formation of the pile on upon the setting of the concrete poured into the pile hole. The fixing means can be varied in accordance with the structure to be fixed thereon and the base plate can take a number of convenient forms. The pile can be a steel cased pile. In this modification the casing is driven into the ground by any suitable method and thereafter filled with concrete, the pile assembly being fitted and correctly positioned in the concrete at the top of the pile before the concrete sets.

What is claimed is:

1. A method for supporting a vertical member having a base at its lower end, said method comprising:

forming a pile hole in the ground, pouring a settable mixture into the pile hole thus formed to form a pile, before the thus poured settable mixture sets, accurately positioning a pile cap assembly in the top portion of the pile, said assembly comprising a mounting plate having a tubular member attached thereto and projecting downwardly therefrom and a plurality of fixing elements extending upwardly therefrom for securing the base of the vertical member to said mounting plate, wherein said positioning is accomplished by inserting said tubular member into the thus poured settable mixture and manoeuvreing said tubular member in the thus poured settable mixture prior to the thus poured settable mixture setting such that the plurality of fixing elements is accurately positioned when the thus poured settable mixture sets.

2. A method in accordance with claim 1, wherein said base of the vertical member has a plurality of fixing holes formed therein at positions in said base corresponding to the positions of the plurality of fixing elements in said mounting plate, further comprising positioning said vertical member so that said each of said plurality of fixing elements extends through a respective one of said plurality of fixing holes, and utilizing said fixing elements to attach the base of the thus positioned vertical member to said mounting plate.

3. A method in accordance with claim 2, wherein said vertical member comprises a flag pole.

4. A method in accordance with claim 2, wherein said vertical member comprises a lamp standard.

5. A method in accordance with claim 1, wherein said mounting plate has a plurality of tubular members attached thereto and projecting downwardly therefrom; wherein the step of forming a pile hole in the ground comprises forming a plurality of pile holes in the ground, with the spacing of the plurality of pile holes corresponding to the spacing of the plurality of tubular members on said mounting plate; wherein the step of pouring a settable mixture into the pile hole thus formed to form a pile comprises pouring a settable mixture into each of the pile holes to form a plurality of piles; and wherein the step of positioning a pile cap assembly in the top portion of the pile comprises inserting each said tubular member into the settable mixture in a respective one of the pile holes and manoeuvreing said mounting plate to adjust the position of each said tubular member in the thus poured settable mixture in the respective pile hole prior to the thus poured settable mixture in the plurality of pile holes setting such that the fixing elements are accurately positioned when the thus poured settable mixture sets.

6. A method in accordance with claim 5, wherein said base of the vertical member has a plurality of fixing holes formed therein at positions in said base corresponding to the positions of the plurality of fixing elements in said mounting plate, further comprising positioning said vertical member so that said each of said plurality of fixing elements extends through a respective one of said plurality of fixing holes, and utilizing said fixing elements to attach the base of the thus positioned vertical member to said mounting plate.

7. A method in accordance with claim 6, wherein said vertical member is an upright in a building structure utilizing portal frames.

8. A method in accordance with claim 1, wherein the horizontal dimensions of the mounting plate are greater than the corresponding dimensions of said pile hole in the ground.

9. A method in accordance with claim 1, wherein the outside diameter of said tubular member is at least as great as one-fourth of the diameter of the pile hole in the ground while being substantially less than the outside diameter of the pile hole in the ground such that the tubular member can be manoeuvred both laterally and vertically in the pile hole in the ground containing the settable mixture, before the settable mixture sets, to ensure that the fixing elements are accurately positioned in their desired locations and that the mounting plate is positioned in a desired orientation plane.

10. A structure comprising:

a pile member formed by casting a settable mixture in situ in a pile hole in the ground;

a pile cap assembly, said pile cap assembly comprising a mounting plate on the top of the pile member, a tube attached to and projecting downwardly from said mounting plate into the uppermost portion of the pile member, said tube having been incorporated in the upper end of the pile member prior to the setting of said settable mixture, and a plurality of fixing elements extending upwardly from said mounting plate for securing a base of a vertical member to said mounting plate, wherein said tube is accurately positioned within the portion of the settable mixture in the top portion of the pile member prior to the setting of the settable mixture so as to provide an accurate positioning of said vertical member.

11. A structure in accordance with claim 10, wherein an upper end of said tube is welded to said mounting plate.

12. A structure in accordance with claim 10, wherein said base of the vertical member has a plurality of fixing holes formed therein at positions in said base corresponding to the positions of the plurality of fixing elements in said mounting plate, wherein said vertical member is positioned so that said each of said plurality of fixing elements extends through a respective one of said plurality of fixing holes, and wherein said vertical member has its base secured to said mounting plate by said plurality of fixing elements.

13. A structure in accordance with claim 12, wherein said fixing elements comprise a plurality of threaded rods extending through the corresponding fixing holes in said base, and at least one threaded nut is in threaded engagement with each threaded rod, the threaded nuts being positioned above said base.

14. A structure in accordance with claim 13, wherein the corresponding fixing holes in said base are oversized, with respect to said threaded rods, thereby permitting adjustment of said base with respect to said mounting plate.

15. A structure in accordance with claim 14, wherein said vertical member comprises a flag pole.

16. A structure in accordance with claim 14, wherein said vertical member comprises a lamp standard.

17. A structure in accordance with claim 8, wherein there is a plurality of pile members formed by casing a settable mixture in situ in a plurality of pile holes in the ground, wherein said mounting plate has a plurality of tubes attached thereto and projecting downwardly therefrom, with each tube being incorporated in the upper portion of a pile member in a respective pile hole.

18. A structure in accordance with claim 17, further comprising said vertical member having its base secured to said mounting plate by said fixing elements.

19. A structure in accordance with claim 18, wherein an upper end of each of said tubes is welded to said mounting plate, and wherein said vertical member is an upright in a building structure utilizing portal frames.

20. A structure in accordance with claim 18, wherein said plurality of fixing elements comprises a plurality of vertically extending rods, each vertically extending rod being positioned coaxially in a respective one of said tubes and extending upwardly through an opening in said mounting plate and a corresponding opening in said base.

21. A structure in accordance with claim 20, wherein each rod has a threaded upper end, and has a threaded nut positioned above said base and in threaded engagement with the respective rod.

22. A structure in accordance with claim 20, wherein each rod has an anchor secured to a lower end of the rod at a point below the bottom of the respective tube so as to serve as an anchor in the settable mixture after the settable mixture has set.

23. A structure in accordance with claim 10, wherein the horizontal dimensions of the mounting plate are greater than the corresponding dimensions of said pile hole in the ground.

24. A structure in accordance with claim 10, wherein the outside diameter of said tube is at least as great as one-fourth of the diameter of the pile hole in the ground while being substantially less than the outside diameter of the pile hole in the ground such that the tube can be manoeuvred both laterally and vertically in the pile hole in the ground containing the settable mixture, before the settable mixture sets, to ensure that the fixing elements are accurately positioned in their desired locations and that the mounting plate is positioned in a desired orientation plane.

* * * * *

UNITED STATES PATENT AND TRADEMARK OFFICE

CERTIFICATE OF CORRECTION

PATENT NO. : 5,437,519

DATED : August 1, 1995

INVENTOR(S) : Roger A. Bullivant

It is certified that error appears in the above-indentified patent and that said Letters Patent is hereby corrected as shown below:

Column 6, line 62, delete "claim 8" and insert --claim 10--.

Signed and Sealed this

Thirtieth Day of January, 1996

Bruce Lehman

*Attest:*

BRUCE LEHMAN

*Attesting Officer*

*Commissioner of Patents and Trademarks*